US007718596B2

(12) United States Patent
Briggs et al.

(10) Patent No.: US 7,718,596 B2
(45) Date of Patent: May 18, 2010

(54) UNIT DOSE LAUNDRY PRODUCTS CONTAINING FATTY ACID ESTERS

(75) Inventors: Stephen Leonard Briggs, Wirral (GB); Lisa Emma Fildes, Wirral (GB); Craig Warren Jones, Wirral (GB)

(73) Assignee: The Sun Products Corporation, Wilton, CT (US)

( * ) Notice: Subject to any disclaimer, the term of this patent is extended or adjusted under 35 U.S.C. 154(b) by 345 days.

(21) Appl. No.: 11/632,879

(22) PCT Filed: Jun. 16, 2005

(86) PCT No.: PCT/EP2005/006517

§ 371 (c)(1), (2), (4) Date: Jan. 19, 2007

(87) PCT Pub. No.: WO2006/007911

PCT Pub. Date: Jan. 26, 2006

(65) Prior Publication Data

US 2008/0242579 A1 Oct. 2, 2008

(30) Foreign Application Priority Data

Jul. 20, 2004 (GB) ..... 0416155.0

(51) Int. Cl.
*C11D 17/00* (2006.01)

(52) U.S. Cl. ..... 510/439; 510/527

(58) Field of Classification Search ..... 510/439, 510/522, 527

See application file for complete search history.

(56) References Cited

U.S. PATENT DOCUMENTS

| | | | | |
|---|---|---|---|---|
| 2,566,359 | A | 9/1951 | Owen | |
| 4,386,213 | A | 5/1983 | Giesecke et al. | |
| 4,569,773 | A | 2/1986 | Ramachandran et al. | 252/8.7 |
| 4,605,506 | A | 8/1986 | Wixon | 252/8.75 |
| 4,775,492 | A | 10/1988 | Vipond et al. | |
| 4,818,421 | A | 4/1989 | Boris et al. | 252/8.8 |
| 4,851,138 | A | 7/1989 | Jaroschek et al. | 252/88 |
| 5,225,100 | A | 7/1993 | Fry et al. | 252/174.25 |
| 5,507,970 | A | 4/1996 | Ishikawa et al. | |
| 5,972,870 | A | 10/1999 | Anderson | 510/298 |
| 6,391,845 | B1 | 5/2002 | Speed et al. | |
| 6,486,117 | B1 | 11/2002 | Painter et al. | |
| 6,566,115 | B1 | 5/2003 | Weisgerber et al. | |
| 6,610,640 | B1 | 8/2003 | Zappone et al. | 510/296 |
| 6,727,220 | B1 | 4/2004 | Grainger et al. | |
| 6,815,410 | B2 | 11/2004 | Boutique et al. | |
| 3,047,132 | A1 | 8/2006 | Bone et al. | |
| 7,115,173 | B2 | 10/2006 | Caswell et al. | |
| 2001/0018410 | A1 | 8/2001 | Grainger et al. | |
| 2001/0034315 | A1 | 10/2001 | Grainger et al. | |
| 2001/0053754 | A1 | 12/2001 | Hewitt et al. | |
| 2002/0013243 | A1 | 1/2002 | Hewitt et al. | |
| 2002/0198125 | A1 | 12/2002 | Jones | |
| 2003/0054966 | A1 | 3/2003 | Bone et al. | |
| 2003/0134766 | A1 | 7/2003 | Jones et al. | |
| 2003/0199414 | A1* | 10/2003 | Boutique et al. | 510/293 |
| 2003/0199415 | A1 | 10/2003 | Mondin | |
| 2004/0063928 | A1 | 4/2004 | Jo | |
| 2004/0115375 | A1 | 6/2004 | Duffield et al. | |
| 2006/0205631 | A1 | 9/2006 | Smerznak et al. | |
| 2007/0287658 | A1 | 12/2007 | Briggs et al. | |
| 2008/0242580 | A1 | 10/2008 | Briggs et al. | |
| 2008/0261850 | A1 | 10/2008 | Briggs et al. | |

FOREIGN PATENT DOCUMENTS

| | | | |
|---|---|---|---|
| AU | 14416/88 | B | 10/1988 |
| CA | 2 450 149 | A1 | 12/2002 |
| CA | 2 562 113 | A1 | 10/2005 |
| CA | 2 583 298 | A1 | 5/2006 |
| EP | 0 845 523 | | 6/1998 |
| EP | 1 431 381 | A1 | 6/2004 |
| EP | 1 431 383 | | 6/2004 |
| EP | 1 486 559 | A1 | 12/2004 |
| FR | 2 780 411 | A1 | 12/1999 |
| GB | 1 235 292 | A | 6/1971 |
| GB | 1 598 102 | A | 9/1981 |
| GB | 2 204 608 | | 11/1988 |
| GB | 2 247 463 | A | 3/1992 |
| JP | 2001-40398 | A | 2/2001 |
| WO | 95/22594 | | 8/1995 |
| WO | WO 98/16538 | A1 | 4/1998 |
| WO | 02/097026 | | 12/2002 |

(Continued)

OTHER PUBLICATIONS

GB Search Report in a GB application GB 0416155.0.

(Continued)

*Primary Examiner*—John R Hardee
(74) *Attorney, Agent, or Firm*—Sterne, Kessler, Goldstein & Fox P.L.L.C.

(57) ABSTRACT

A unit dose fabric treatment system comprises a water soluble container in which a liquid fabric treatment composition is disposed, the composition comprising one or more fatty acid esters wherein, in at least one of the fatty acid esters, the average proportion of C18 chains is less than 60%, preferably less than 50%, more preferably less than 40%, e.g. less than 30% by weight of the total weight of fatty acid chains in the fatty acid ester.

13 Claims, No Drawings

FOREIGN PATENT DOCUMENTS

| | | | |
|---|---|---|---|
| WO | 02/102956 | | 12/2002 |
| WO | WO 02/102955 | A1 | 12/2002 |
| WO | 2004/011589 | | 2/2004 |
| WO | WO 2006/037469 | A1 | 4/2006 |
| WO | WO 2006/045391 | A1 | 5/2006 |
| WO | WO 2006/076952 | A1 | 7/2006 |

OTHER PUBLICATIONS

PCT International Search Report in a PCT application PCT/EP2005/006517.

Allen, D. K., and Tao, B.Y., "Carbohydrate-Alkyl Ester Derivatives as Biosurfactants," Journal of Surfactants and Detergents, 2(3): 383-390 (Jul. 1999), Springer, Berlin / Heidelberg, Germany.

English language abstract for FR 2780411, Dialog File 351, WPI Accession No. 2000-118774/200011, published Dec. 31, 1999, The Thomson Corporation (2007) (listed as document FP5 on the accompanying form PTO/SB/08A).

English language Abstract for JP 2001-040398 A, published Feb. 13, 2001, Japanese Patent Office, Patent & Utility Model Gazette DB (listed as document FP14 on the accompanying form PTO/SB/08A).

International Search Report for International Application No. PCT/EP2005/010187, Rijswijk, Netherlands, mailed on Dec. 7, 2005 (3 pages).

International Search Report for International Application No. PCT/EP2005/010402, Rijswijk, Netherlands, mailed on Jan. 12, 2006 (3 pages).

International Search Report for International Application No. PCT/EP2007/055131, Rijswijk, Netherlands, mailed on Sep. 25, 2007 (2 pages).

Maag, H., "Fatty Acid Derivatives: Important Surfactants for Household, Cosmetic and Industrial Purposes," *Journal of the American Oil Chemists' Society 61*:259-267 Springer, Berlin / Heidelberg, Germany (1984).

Search Report completed Mar. 4, 2005, for Great Britain Application No. GB0422026.5 (1 page).

Search Report completed Mar. 16, 2005, for Great Britain Application No. GB0423986.9 (1 page).

Search Report completed Sep. 26, 2006, for Great Britain Application No. GB0610801.3 (1 page).

Thomssen, E.G., and McCutcheon, J.W., "Soaps and Detergents," MacNair-Dorland Company, (1949), pp. 259-269.

* cited by examiner

UNIT DOSE LAUNDRY PRODUCTS CONTAINING FATTY ACID ESTERS

FIELD OF THE INVENTION

This invention relates to unit dose fabric treatment system.

BACKGROUND OF THE INVENTION

Detergent compositions manufactured in the form of compacted detergent powder are known. U.S. Pat. No. 5,225,100, for example, describes a tablet of compacted powder comprising an anionic detergent compound, which will adequately disperse in the wash water.

Laundry detergent compositions which further include a fabric softener to provide softening or conditioning of fabrics in the wash cycle of the laundering operation are well-known and described in the patent literature. See, for example, U.S. Pat. No. 4,605,506 (Wixon); U.S. Pat. No. 4,818,421 (Boris) et al. and U.S. Pat. No. 4,569,773 (Ramachandran et al.) and U.S. Pat. No. 4,851,138. U.S. Pat. No. 5,972,870 (Anderson) describes a multi-layered laundry tablet for washing which may include a detergent in the outer layer and a fabric softener, or water softener or fragrance in the inner layer.

These types of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. That is, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. However, these type products are characterised by the same inconvenience inherent with the use of powered detergents, namely, problems of handling, caking in the container or wash cycle dispenser, and the need for a dosing device to deliver the desired amount of active softener material to the wash water.

WO04/011589 discloses a softening system which comprises:

(a) a water soluble container which is formed from a water soluble polymer which is selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylates, water soluble polyacrylamides and acrylic acid/maleic anhydride copolymers;

(b) a liquid fabric softener composition disposed in said water soluble container, wherein said fabric softener composition comprises approximately by weight 72% to 100% of at least one organic softening agent which is selected from the group consisting of fatty acid soaps, esters of glycerol, ethoxylated fatty esters of glycerol, ethoxylated fatty esters, fatty alcohols, polyol polymers, higher fatty acid esters of a pentaerythritol compound silicone oil compounds, olein esterquat compounds, olein amido-amine compounds, quaternized alkyl imidazoline compounds, synthetic esters and natural esters and mixtures thereof.

The use of a unit dose fabric softening composition contained in a water soluble container such as a sachet offers numerous advantages. To be effective, the unit dose fabric softening compositions, contained in a sachet, must be able to disperse in the wash liquor in a short period of time to avoid any residue at the end of the wash cycle.

Typically, the wash cycle time can be as short as 12 minutes and as long as 90 minutes (in typical European washers) depending on the type of washer and the wash conditions. Therefore, the water-soluble sachet must be soluble in the wash liquor before the end of the cycle.

OBJECT OF THE INVENTION

The aim of this invention is to seek to overcome one or more of the aforementioned disadvantages and/or to provide one or more of the aforementioned benefits.

STATEMENT OF THE INVENTION

Thus, according to the present invention there is provided a fabric treatment system in the form of a unit dose comprising:

(a) a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers; and (b) a liquid fabric softener composition disposed in said water soluble container, wherein said fabric treatment composition comprises:

(i) one or more fatty acid esters;

(ii) optionally a fatty acid soap, (iii) optionally fatty acid (iv) optionally perfume, and (v) optionally a cellulose ether cationic deposition polymer, wherein, in at least one of the fatty acid esters, the average proportion of C18 chains is less than 60%, preferably less than 50%, more preferably less than 40%, e.g. less than 30% by weight of the total weight of fatty acid chains in the fatty acid ester.

The composition is present in an amount within the water-soluble container which is sufficient to form a unit dose capable of providing effective softening, conditioning or other laundry treatment of fabrics in said washing machine.

The term "fabric softener" is used herein for purposes of convenience to refer to materials which provide softening and/or conditioning benefits to fabrics in a home or automatic laundering machine.

DETAILED DESCRIPTION OF THE INVENTION

The present invention relates to a water soluble sachet containing a unit dose of a fabric softener composition.

Preferably the water soluble sachet is formed from a single layer of water soluble thermoplastic film.

The film is advantageously formed from a water soluble polymer which is preferably selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkylhydroxy cellulosic such as hydroxy ethylcellulose, hydroxypropyl cellulose, carboxy-methylcellulose sodium, dextrin, maltodextrin, alkyl cellulosics such as methyl cellulose, ethyl cellulose and propyl cellulose, ethers and esters of alkyl cellulosics such as methyl cellulose, ethyl cellulose and propyl cellulose, water soluble polyacrylates, water soluble polyacrylamides and acrylic acid/maleic anhydride copolymers.

Especially preferred water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Monosol LLC. Other suitable resins include poly(ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is PVA produced by Monosol LLC. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The inner surface of the film is in contact with the laundry treatment composition and the external surface of the film does not have a water soluble glue disposed thereon.

The water soluble container can be in the form of a pouch, sachet, a blow moulded capsule or other blow moulded shapes, an injected moulded ampoule or other injection moulded shapes, or rotationally moulded spheres or capsules.

Examples of suitable methods for forming water soluble containers are as follows:

The pelletized, pre-dried, melt processable polyvinyl alcohol (PVA) resin, is fed to a film extruder. The feed material may also contain pre-dried colour concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties.

Alternatively, the PVA resins can also be dissolved and formed into film through a solution-casting process, wherein the PVA resin or resins are dissolved and mixed in an aqueous solution along with additives. This solution is cast through a coat hanger die, or in front of a doctor blade or through a casting box to produce a layer of solution of consistent thickness. This layer of solution is cast or coated onto a drum or casting band or appropriate substrate to convey it through an oven or series of ovens to reduce the moisture content to an appropriate level. The extruded or cast film is slit to the appropriate width and wound on cores. Each core holds one reel of film.

There are many types of form fill seal machines that can convert water soluble films into containers, including vertical, horizontal and rotary machines. To make the appropriate sachet shape, one or multiple films can be used. The film can be folded into the sachet shape, mechanically deformed into the sachet shape, or thermally deformed into the sachet shape. The sachet forming can also utilize thermal bonding of multiple layers of film, or solvent bonding of multiple layers of film. When using poly(vinyl) alcohol the most common solvent is water.

Once the appropriately shaped sachet is filled with product, the sachet can be sealed using either thermal bonding of the film, or solvent bonding of the film.

Blow moulded capsules can be formed from the poly(vinyl) alcohol resin having a molecular weight of about 50,000 to about 70,000 and a glass transition temperature of about 28 to 33° C. Pelletized resin and concentrate(s) are fed into an extruder having a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split moulds. The moulds control the final shape of the package. While in the mould, the package is filled with the appropriate volume of liquid. The mould quenches the plastic. The liquid is contained within the interior volume of the blow moulded package.

An injection moulded ampoule or capsule can be formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection moulding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mould or hot runner system which feeds several moulds. The moulds control the shape of the finished package. The package may be filled with liquid either while in the mould or after ejection from the mould. The filling port of the package is heat sealed after filling is completed. This process may be conducted either in-line or off-line.

A rotationally moulded sphere or capsule can be formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mould having the desired shape and volume. The mould is sealed and heated while simultaneously rotating in three directions. The powder melts and coats the entire inside surface of the mould. While continuously rotating, the mould is cooled so that the resin solidifies into a shape which replicates the size and texture of the mould.

After formation of the finished package, the liquid is injected into the hollow package using a heated needle or probe after filling, the injection port of the package is heat sealed. Typical unit dose compositions for use herein may vary from about 5 to about 40 ml corresponding on a weight basis to about 5 to about 40 grams (which includes the weight of the capsule).

Fabric Treatment Composition

Fatty Acid Ester

The composition comprises one or more fatty acid esters.

Suitable fatty acid esters are fatty esters of mono or polyhydric alcohols having from 8 to about 24 carbon atoms in the fatty acid chain. Such fatty esters are preferably substantially odorless.

In at least one of the fatty acid esters, the average proportion of C18 chains is less than 60%, preferably less than 50%, more preferably less than 40%, e.g. less than 30% by weight of the total weight of fatty acid chains in the fatty acid ester.

In the context of the present invention, "C18 chains" denotes the combined amount of C18, C18:1 and C18:2 chains.

The average proportion of C18 chains in sunflower oil, for instance, is typically above 70 wt %.

Thus, at least one of the fatty acid esters is not sunflower oil.

It is preferred if the fatty acid ester is a fatty acid glyceride or mixtures of fatty acid glycerides. Especially preferred materials are triglycerides, most preferred are palm oil, palm kernel oil, and coconut oil.

Sunflower oil may also be present but only in combination with one or more of the fatty acid esters defined above.

Blending different fatty triglycerides together can be advantageous since certain blends, such as coconut oil and sunflower oil, provide the composition with reduced viscosity when compared with compositions comprising only one oil. This has been found to provide the composition with better flow characteristics for the filling of capsules, which is particularly important when operating on an industrial scale.

Fatty Acid

A fatty acid is preferably present in the composition.

Any reference to "fatty acid" herein means "free fatty acid" unless otherwise stated and it is to be understood that any fatty acid which is reacted with another ingredient is not defined as a fatty acid in the final composition, except insofar as free fatty acid remains after the reaction.

Preferred fatty acids are those where the weighted average number of carbons in the alkyl/alkenyl chains is from 8 to 24, more preferably from 10 to 22, most preferably from 12 to 18.

The fatty acid can be saturated or unsaturated.

The fatty acid may be an alkyl or alkenyl mono- or polycarboxylic acid, though monocarboxylic acids are particularly preferred.

The fatty acid can be linear or branched. Non-limiting examples of suitable branching groups include alkyl or alkenyl groups having from 1 to 8 carbon atoms, hydroxyl groups, amines, amides, and nitrites.

Suitable fatty acids include both linear and branched stearic, oleic, lauric, linoleic, and tallow—especially hardened tallow—acids, and mixtures thereof.

The amount of fatty acid is preferably from 0.5 to 40 wt %, more preferably from 2.5 to 30 wt %, most preferably from 5 to 25 wt %, based on the total weight of the composition.

Fatty Acid Soap

A fatty acid soap is preferably present in the composition.

Useful soap compounds include the alkali metal soaps such as the sodium, potassium, ammonium and substituted ammonium (for example monoethanolamine) salts or any combinations of this, of higher fatty acids containing from about 8 to 24 carbon atoms.

In a preferred embodiment of the invention the fatty acid soap has a carbon chain length of from $C_{10}$ to $C_{22}$, more preferably $C_{12}$ to $C_{20}$.

Suitable fatty acids can be obtained from natural sources such as plant or animal esters e.g. palm oil, coconut oil, babassu oil, soybean oil, caster oil, rape seed oil, sunflower oil, cottonseed oil, tallow, fish oils, grease lard and mixtures thereof. Also fatty acids can be produced by synthetic means such as the oxidation of petroleum, or hydrogenation of carbon monoxide by the Fischer Tropsch process. Resin acids are suitable such as rosin and those resin acids in tall oil. Naphthenic acids are also suitable. Sodium and potassium soaps can be made by direct saponification of the fats and oils or by the neutralisation of the free fatty acids which are prepared in a separate manufacturing process.

Particularly useful are the sodium and potassium salts and the mixtures of fatty acids derived from coconut oil and tallow, i.e. sodium tallow soap, sodium coconut soap, potassium tallow soap, potassium coconut soap.

For example Prifac 5908 a fatty acid from Uniqema which was neutralised with caustic soda. This soap is an example of a fully hardened or saturated lauric soap, which in general is based on coconut or palm kernel oil.

Also mixtures of coconut or palm kernel oil and for example palm oil, olive oil, or tallow can be used. In this case more palmitate with 16 carbon atoms, stearate with 18 carbon atoms, palmitoleate with 16 carbon atoms and with one double bond, oleate with 18 carbon atoms and with one double bond and/or linoleate with 18 carbon atoms and with two double bonds are present.

Thus, the soap may be saturated or unsaturated.

It is particularly preferred that the alkali metal hydroxide is potassium or sodium hydroxide, especially potassium hydroxide.

The fatty acid soap is preferably present at a level of from 1 to 50 wt %, more preferably from 2 to 40 wt %, most preferably from 3 to 30 wt %, e.g. from 4 to 15 wt %, based on the total weight of the composition.

Nonionic Surfactant

Nonionic surfactants suitable for use in the compositions include any of the alkoxylated materials of the particular type described hereinafter can be used as the nonionic surfactant.

Substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

—O—, —C(O)O—, —C(O)N(R)— or —C(O)N(R)R— in which R has the meaning given above or can be hydrogen; and Z is at least about 3, preferably about 5, more preferably at least about 7 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO(18), and tallow alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

The above ethoxylated nonionic surfactants are useful in the present compositions alone or in combination, and the term "nonionic surfactant" encompasses mixed nonionic surface active agents.

The nonionic surfactant is preferably present in an amount from 1 to 30%, more preferably 2 to 12%, most preferably 3 to 9%, e.g. 4 to 8% by weight, based on the total weight of the composition.

Perfume

It is desirable that the compositions of the present invention also comprise one or more perfumes. Suitable perfume ingredients include those disclosed in "Perfume and Flavour Chemicals (Aroma Chemicals)", by Steffen Arctander, published by the author in 1969, the contents of which are incorporated herein by reference.

The perfume is preferably present in the composition at a level of from 0.5 to 15 wt %, more preferably from 1 to 10 wt %, most preferably from 2 to 5 wt %, based on the total weight of the composition.

As used herein and in the appended claims the term "perfume" is used in its ordinary sense to refer to and include any non-water soluble fragrant substance or mixture of substances including natural (i.e. obtained by extraction of flower, herb, blossom or plant), artificial (i.e. mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 1% to 70% by weight, the essential oils themselves being volatile odoriferous compounds and also serving to dissolve the other components of the perfume.

Cationic Polymer

It is desirable that the composition further comprises a cationic polymer. The cationic polymer significantly boosts softening performance on fabrics delivered by the composition.

A particularly preferred class of cationic polymer is cationic cellulose ethers. Such ethers are commercially available under the tradename Ucare LR-400 ([2-hydroxy-3(trimethylammonio)propyl]-w-hydroxypoly(oxy-1,2-ethanediyl) chloride).

The polymer is preferably present at a level of from 0.1 to 5 wt %, more preferably from 0.2 to 2 wt %, most preferably from 0.25 to 1 wt %, based on the total weight of the composition.

Non-Surfactant Liquids

Non-surfactant liquids, such as non-surfactant solvents can be present in the composition. Preferred liquids include ethers, polyethers, alkylamines and fatty amines, (especially di- and trialkyl- and/or fatty-N-substituted amines), alkyl (or fatty) amides and mono- and di-N-alkyl substituted derivatives thereof, alkyl (or fatty) carboxylic acid lower alkyl esters, ketones, aldehydes, polyols, and glycerides.

Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Glycerol is particularly preferred since it provides the additional benefit of plasticising the water soluble film.

Other suitable solvents are lower (C14) alcohols, such as ethanol, or higher (C5-9) alcohols, such as hexanol, as well as alkanes and olefins. It is often desirable to include them for lowering the viscosity of the product and/or assisting soil removal during cleaning.

Preferably, the compositions of the invention contain the organic solvent in an amount of at least 0.1% by weight of the total composition. The amount of the solvent present in the composition may be as high as about 60%, but in most cases the practical amount will lie between 1 and 30% and sometimes, between 2 and 20% by weight of the composition.

Water

The compositions preferably comprise a low level of water. Thus, water is preferably present at a level of from 0.1 to 10 wt %, more preferably from 2 to 10 wt %, most preferably from 3 to 7 wt %, based on the total weight of the composition.

Cationic Surfactants

The compositions of the invention are preferably substantially free, more preferably entirely free of cationic surfactants, since the compositions are primarily for use in the wash cycle of an automatic washing machine. Thus, it is preferred that the maximum amount of cationic surfactant present in the composition is 5 wt % or less, more preferably 4 wt % or less, even more preferably 3 wt % or less, most preferably 2 wt % or less, e.g. 1 wt % or less, based on the total weight of the composition.

It is well known that anionic surfactants are typically present in the wash detergent and so would complex undesirably with any cationic surfactant in the composition thereby reducing the effectiveness of the wash detergent.

Other Optional Ingredients

The compositions may also contain one or more optional ingredients conventionally included in fabric treatment compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, germicides, fungicides, anti-corrosion agents, drape imparting agents, anti-static agents, ironing aids crystal growth inhibitors, anti-oxidants, anti-reducing agents and dyes.

EXAMPLES

The following examples illustrate liquid laundry treatment compositions used in the invention.

Examples of the invention are denoted by a number and comparative examples are denoted by a letter.

Unless otherwise specified, the amounts and proportions in the compositions and films are by weight.

Examples 1, 2 and A to F were prepared by charging the triglyceride oil or glycerol, ethoxylated alcohol and fatty acids to a 1 liter beaker. A 50% KOH solution was then added and the temperature kept below 60° C. by altering the addition rate as necessary. The mixture was left to cool to below 40° C. under stirring and then the perfume was added. The product was then left to cool to room temperature without stirring. A high viscosity opaque liquid resulted.

In Example 2, the potassium oleate was formed in-situ via the addition of a 50% m/m. aqueous solution to the sunflower oil, coconut oil and oleic acid mixture. Stearic acid was added after the oleic acid neutralization. The water content in this example includes the water of neutralization.

25 g of each of examples 1, 2 and A to F was encapsulated in about 1 g of poly(vinylalcohol) film via typical thermoforming techniques, as described above. 1 capsule was employed per washing assessment.

Example G was dosed at 107 g into the main-wash cycle dispensing drawer and Example H (1 tablet) was placed in a net bag and loaded into the drum.

EVALUATION

A mixed ballast load comprising 25% Terry towel, 25% jersey, 25% poly-cotton, and 25% cotton sheeting together with eight 20 cm×20 cm Terry Towel monitors was added to a Miele 820 front loading automatic machine. The machine was set to a 40° C. cotton cycle. Example G (107 g) was added to the drawer and used with no other products. Example H was placed into the net bag provided with the product and Examples 1, 2 and A to F were used as made. Examples 1, 2, A to F and H were added to the drum and placed at the back on top of the ballast. After the wash, rinse and spin cycles were complete the monitors were extracted, and left to dry on a line for 24 hours prior to softness and perfume assessment.

Perfume assessment was carried out by a sensory panel of six trained panellists who were asked to rank the cloths for

TABLE 1

| Example | 1 | 2 | 3 | 4 | A | B | C | D | E | F |
|---|---|---|---|---|---|---|---|---|---|---|
| Sunflower oil[a] | | 14.0 | 14.0 | 14.0 | | 57.2 | 57.0 | | 58.5 | 58.5 |
| Glycerol[b] | | | | | 57.2 | | | 57.2 | | |
| Coconut oil[c] | 57.2 | 45.0 | 45.0 | 44.6 | | | | | | |
| LR-400[d] | | | | | | | 0.25 | | | |
| Potassium oleate[e] | 16.3 | 18.2 | 18.2 | | 16.3 | 16.3 | 16.3 | 16.3 | 22.5 | 14.5 |
| stearic acid | | 6.5 | 4.0 | 4.0 | | | | | | |
| Potassium stearate[f] | 8.0 | | | | 8.0 | 8.0 | 8.0 | 3.0 | | 8.0 |
| oleic acid | | | 2.5 | | | | | | | |
| Potassium laurate[k] | | | | 17.9 | | | | | | |
| Lauric acid[j] | | | | 3.5 | | | | | | |
| Perfume | 5.0 | 4.0 | 4.0 | 4.0 | 5.0 | 5.0 | 5.0 | 5.0 | 5.0 | 5.0 |
| Neodol 25-7E[g] | 6.5 | 6.5 | 6.5 | 6.5 | 6.5 | 6.5 | 6.5 | 6.5 | 6.5 | 6.5 |
| BHT[h] | | 0.05 | 0.05 | 0.05 | | | | | | |
| Free fatty acid[I] | 0.5 | | | | 0.5 | 0.5 | 0.5 | 5.0 | | |
| water | | | | | To 100 | | | | | |

[a]purchased in Tesco, UK April 2004;
[b]Ex. Sigma-Aldrich (used as received);
[c]Ex. Coconut Island Products;
[d]Ex. Dow Chemical Company added as a powder;
[e]Formed in-situ from oleic acid and KOH;
[f]Formed in-situ from stearic acid and KOH;
[g]C12-15 alcohol 7EO;
[h]2,6-Di-tertiary-4-methoxyphenol ex. Sigma Aldrich;
[I]level altered by changing the concentration of KOH added to prepare the potassium soaps;
[j]Ex. Uniquema;
[k]Formed in situ from lauric acid and KOH Example G is Bold 2-in-1 powder (Ocean Fresh variant) purchased in the U.K. during April 2004.

Example H is Soupline Hearts, purchased in France during March 2004.

perfume strength on a scale of 0 to 4 where 0 denotes no perfume, 1 means slight, 2 means moderate, 3 means strong, and 4 denotes very strong perfume.

Softening assessment was also conducted by a trained panel of at least six panellists who were asked to rank the monitors on a scale 0-100, where 0 denotes not at all soft and 100 denotes extremely soft. Each panellist placed a mark along a line which had ends marked 0 and 100 respectively.

Perfume and softening results were analyzed using a statistics package, Tukey-Hamer HSD.

TABLE 2

| Perfume evaluation | |
|---|---|
| Example | Perfume |
| 1 | 1.9 |
| A | 0.5 |
| B | 0.8 |
| C | 1.2 |
| D | 0.6 |
| G | 1.0 |
| H | 1.5 |

TABLE 3

| Softening evaluation | |
|---|---|
| Example | Softening score |
| 2 | 41 |
| H | 43 |

TABLE 3a

| Softening evaluation (separate test) | |
|---|---|
| Example | Softening score |
| 3 | 31.4 |
| 4 | 37.8 |
| G | 38.6 |

Further Perfume Evaluation

A load comprising a 50:50 mixture of Terry towel and cotton sheeting at a weight of 2.5 Kg was placed in the drum of a Hotpoint washing machine. Ten 20×20 cm polyester monitors were added to the load. 1 tablet inside a net (example H) or 1 capsule (example 2) was placed on top of the load. Detergent (115 g of unperfumed Persil non-biological powder) was placed in the main wash cycle dispensing drawer.

A cotton cycle wash was performed.

The monitors were assessed by the expert panel immediately upon removal from the machine, after which they were line dried at 20° C. and 65% RH. Further assessments were made after 24 hours and 96 hours. Perfume assessment was made using the scale described above.

The results are given in the following table.

TABLE 4

| Example | Time | Perfume Strength |
|---|---|---|
| H | Damp | 1.1 ± 0.80 |
| | 24 hr. | 1.09 ± 0.69 |
| | 96 hr. | 0.78 ± 0.42 |
| 2 | Damp | 2.29 ± 0.72 |

TABLE 4-continued

| Example | Time | Perfume Strength |
|---|---|---|
| | 24 hr. | 2.17 ± 0.76 |
| | 96 hr. | 1.38 ± 0..59 |

The invention claimed is:

1. A fabric treatment system in the form of a unit dose comprising:

(a) a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers;

and (b) a liquid fabric softener composition disposed in said water soluble container, wherein said fabric softener composition comprises:

(i) at least a first and a second fatty acid ester, wherein the source of said first fatty acid ester is different from the source of said second fatty acid ester, and wherein the sources of said first and second fatty acid esters are selected from the group consisting of coconut oil, palm oil, palm kernel oil and sunflower oil;

(ii) a fatty acid soap;

(iii) perfume;

(iv) optionally a fatty acid; and (v) optionally a cellulose ether cationic deposition polymer, wherein, in at least the first fatty acid ester, the average proportion of C18 chains is less than 60% by weight of the total weight of fatty acid chains in the fatty acid ester.

2. A fabric treatment system according to claim 1 in which in at least one of said first and second fatty acid esters the average proportion of C18 chains is less than 40%.

3. A fabric treatment system according to claim 1 wherein fatty acid is present in an amount from 0.1 to 15% by weight based on the total weight of the composition.

4. A fabric treatment system according to claim 1 wherein the source of said first fatty acid ester is coconut oil.

5. A fabric treatment system according to claim 4, wherein said first fatty acid ester is present in the amount of about 57% by weight of the composition.

6. A fabric treatment system as claimed in claim 1 wherein the fatty acid soap comprises an alkali metal soap or ammonium or substituted ammonium salt of a fatty acid containing from 8 to 24 carbon atoms and is present in an amount of from 1 to 50% by weight of the composition.

7. A fabric treatment system according to claim 1 wherein the cationic polymer is present in an amount of from 0.1 to 5% by weight based on the total weight of the composition.

8. A fabric treatment system according to claim 1 wherein said fabric softener composition further comprises water, wherein the level of water is present in an amount less than 10% by weight, based on the total weight of the composition.

9. A fabric treatment system according to claim 1 wherein the perfume is present in an amount from 0.5 to 10% by weight, based on the total weight of the composition.

10. A method of treating a fabric which comprises introducing a fabric treatment system of claim 1 into a home or automatic laundering machine so that it is present during the wash cycle.

11. A fabric treatment system in the form of a unit dose comprising:

(a) a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers;

and (b) a liquid fabric softener composition disposed in said water soluble container, wherein said fabric softener composition comprises:

(i) at least a first and a second fatty acid ester, wherein said first fatty acid ester is derived from palm kernel oil;

(ii) a fatty acid soap;

(iii) perfume;

(iv) optionally a fatty acid; and (v) optionally a cellulose ether cationic deposition polymer, wherein, in at least the first fatty acid ester, the average proportion of C18 chains is less than 60% by weight of the total weight of fatty acid chains in the fatty acid ester.

12. A fabric treatment system in the form of a unit dose comprising:

(a) a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers;

and (b) a liquid fabric softener composition disposed in said water soluble container, wherein said fabric softener composition comprises:

(i) at least a first and a second fatty acid ester, wherein said first fatty acid ester is derived from coconut oil and said second fatty acid ester is derived from sunflower oil;

(ii) a fatty acid soap;

(iii) perfume;

(iv) optionally a fatty acid; and (v) optionally a cellulose ether cationic deposition polymer, wherein, in at least the first fatty acid ester, the average proportion of C18 chains is less than 60% by weight of the total weight of fatty acid chains in the fatty acid ester.

13. A fabric treatment system in the form of a unit dose of claim 12 wherein the formulation of the liquid fabric softener composition comprises about 45% by weight coconut oil esters and about 14% by weight sunflower oil esters.

* * * * *